US010604936B2

(12) United States Patent
Brochu

(10) Patent No.: US 10,604,936 B2
(45) Date of Patent: Mar. 31, 2020

(54) GUTTER GUARD FOR FLOATING GUTTER AND KIT

(71) Applicant: Stéphane Brochu, Lévis (CA)

(72) Inventor: Stéphane Brochu, Lévis (CA)

( * ) Notice: Subject to any disclaimer, the term of this patent is extended or adjusted under 35 U.S.C. 154(b) by 0 days.

(21) Appl. No.: 16/182,841

(22) Filed: Nov. 7, 2018

(65) Prior Publication Data

US 2019/0136536 A1 May 9, 2019

Related U.S. Application Data

(60) Provisional application No. 62/582,998, filed on Nov. 8, 2017.

(51) Int. Cl.

| | |
|---|---|
| ***E04D 13/076*** | (2006.01) |
| ***E04D 13/072*** | (2006.01) |
| ***E04D 13/068*** | (2006.01) |

(52) U.S. Cl.

CPC ..... *E04D 13/076* (2013.01); *E04D 13/068* (2013.01); *E04D 13/0725* (2013.01)

(58) Field of Classification Search

CPC .. E04D 13/068; E04D 13/076; E04D 13/0725
USPC ..... 52/12
See application file for complete search history.

(56) References Cited

U.S. PATENT DOCUMENTS

| | | | | |
|---|---|---|---|---|
| D90,272 | S | 9/1933 | White | |
| 2,277,443 | A | 3/1942 | Livingstone | |
| 3,042,742 | A | 7/1962 | Foster | |
| 4,808,234 | A | 2/1989 | McKay et al. | |
| 4,820,407 | A * | 4/1989 | Lilie | B01D 29/05 209/397 |
| 5,406,754 | A * | 4/1995 | Cosby | E04D 13/076 52/12 |
| 5,744,218 | A | 4/1998 | Barnes | |
| 5,906,287 | A | 5/1999 | Kohnen | |
| D460,197 | S | 7/2002 | Stringer | |
| 6,427,388 | B1 | 8/2002 | Brochu | |
| D468,446 | S | 1/2003 | Sender et al. | |

(Continued)

FOREIGN PATENT DOCUMENTS

| | | |
|---|---|---|
| CA | 2305159 | 4/2000 |
| CA | 2305159 A1 | 10/2001 |

(Continued)

*Primary Examiner* — Christine T Cajilig
(74) *Attorney, Agent, or Firm* — Remenick PLLC

(57) ABSTRACT

A gutter guard for retaining a gutter and for covering an opening of the gutter provided. The gutter has a front wall and a rear wall and the opening is defined by a top edge of the front wall and the top edge of the rear wall. The gutter guard includes a front portion for operatively engaging the front wall of the gutter, a rear portion having an upwardly and rearwardly extending hook member for retaining the rear wall of the gutter and an upstanding member fastenable to an upstanding support structure, and a central portion extending between the front portion and the rear portion and having a plurality of throughholes formed therein. The gutter guard may be multi-layered, having a first sheet member and a second sheet member that are spaced apart and having non-aligned throughholes. A gutter guard kit can include at least one gutter guard and a gutter that are operatively engageable with one another.

22 Claims, 14 Drawing Sheets

(56) References Cited

U.S. PATENT DOCUMENTS

| | | | | |
|---|---|---|---|---|
| 6,701,674 | B1 * | 3/2004 | Albracht | E04D 13/0725 52/11 |
| 6,826,872 | B2 | 12/2004 | Brochu | |
| D523,538 | S * | 6/2006 | Brochu | D23/267 |
| D523,969 | S | 6/2006 | Abruzese et al. | |
| D551,740 | S | 9/2007 | Riley | |
| D569,011 | S | 5/2008 | Brochu | |
| 7,908,797 | B2 | 3/2011 | Graves | |
| 7,913,458 | B2 * | 3/2011 | Higginbotham | E04D 13/076 52/11 |
| D651,292 | S | 12/2011 | Geers | |
| 8,191,315 | B1 | 6/2012 | Brochu | |
| 8,322,082 | B2 | 12/2012 | Neumann | |
| 8,347,557 | B2 * | 1/2013 | Minor, Sr. | E04D 13/076 52/11 |
| D677,405 | S | 3/2013 | Landis | |
| 8,434,269 | B1 | 5/2013 | Brochu | |
| 8,635,811 | B2 * | 1/2014 | Horton | E04D 13/076 52/11 |
| D719,648 | S | 12/2014 | Moody et al. | |
| D721,826 | S | 1/2015 | Ryan | |
| D723,671 | S | 3/2015 | Brochu | |
| 9,010,030 | B2 * | 4/2015 | Davis | E04D 13/076 52/11 |
| D736,900 | S | 8/2015 | Frelier | |
| 9,127,463 | B1 * | 9/2015 | Feldhaus | E04D 13/0725 |
| 9,163,406 | B1 | 10/2015 | Ealer, Sr. | |
| D742,541 | S | 11/2015 | Ryan | |
| D770,603 | S | 11/2016 | Fryml | |
| D782,624 | S | 3/2017 | Haendel | |
| D792,985 | S | 7/2017 | Jones | |
| D796,067 | S | 8/2017 | Landis et al. | |
| 2003/0110712 | A1 | 6/2003 | Brochu | |
| 2004/0060244 | A1 | 4/2004 | Brochu | |
| 2004/0118052 | A1 | 6/2004 | Brochu | |
| 2004/0244302 | A1 | 12/2004 | Neumann | |
| 2005/0028452 | A1 | 2/2005 | Brochu | |
| 2005/0115160 | A1 | 6/2005 | Brochu | |
| 2005/0193642 | A1 | 9/2005 | Brochu et al. | |
| 2005/0193671 | A1 | 9/2005 | Brochu et al. | |
| 2005/0223657 | A1 | 10/2005 | Brochu et al. | |
| 2005/0279036 | A1 | 12/2005 | Brochu | |
| 2006/0037255 | A1 | 2/2006 | Brochu | |
| 2007/0167130 | A1 | 7/2007 | Brochu | |
| 2007/0169423 | A1 * | 7/2007 | Brochu | E04D 13/076 52/12 |
| 2008/0190070 | A1 | 8/2008 | Duncan et al. | |
| 2008/0289263 | A1 | 11/2008 | Brochu | |
| 2009/0013612 | A1 | 1/2009 | Brochu | |
| 2009/0056234 | A1 | 3/2009 | Brochu | |
| 2009/0108144 | A1 * | 4/2009 | Brochu | E04D 13/076 248/48.1 |
| 2011/0138698 | A1 | 6/2011 | Neumann | |
| 2012/0151849 | A1 * | 6/2012 | Brochu | E04D 3/364 52/12 |
| 2013/0091780 | A1 | 4/2013 | Robins | |
| 2016/0060870 | A1 * | 3/2016 | Martin | E04D 13/064 52/12 |

FOREIGN PATENT DOCUMENTS

| | | | |
|---|---|---|---|
| CA | 2405756 | | 9/2002 |
| CA | 2458005 | | 2/2004 |
| CA | 2458006 | | 2/2004 |
| CA | 2460429 | | 3/2004 |
| CA | 2451186 | | 7/2007 |
| CA | 2593808 | | 1/2009 |
| CA | 2608530 | | 4/2009 |
| CA | 2747704 | | 7/2009 |
| CA | 2723499 | | 3/2011 |
| CA | 2723499 | A1 | 3/2011 |
| CA | 2727844 | | 7/2012 |
| CA | 2747513 | | 1/2013 |
| CA | 2783834 | | 8/2013 |
| CA | 2775864 | | 11/2013 |
| CA | 2775864 | A1 | 11/2013 |
| CA | 2933239 | | 7/2015 |
| CA | 2863023 | | 3/2016 |
| CA | 166698 | | 8/2016 |
| CA | 169577 | | 2/2017 |
| CA | 2907280 | | 2/2017 |
| CA | 2955268 | | 7/2017 |
| CA | 2919709 | | 8/2017 |
| CA | 2963962 | | 10/2017 |
| CA | 2931540 | | 11/2017 |
| CA | 175672 | | 4/2018 |
| CA | 2985004 | | 5/2018 |
| CA | 3016527 | | 3/2019 |
| CA | 3023339 | | 5/2019 |
| EP | 1449980 | | 8/2004 |
| EP | 1449980 | A1 | 8/2004 |
| EP | 1627974 | | 2/2006 |
| EP | 1627974 | A | 2/2006 |
| EP | 2159342 | | 3/2010 |
| EP | 2177685 | | 4/2010 |
| EP | 2177685 | A1 | 4/2010 |
| EP | 2251500 | | 4/2017 |
| GB | 2493284 | | 7/2011 |
| GB | 2841033 | | 12/2011 |
| GB | 2493284 | A | 1/2013 |
| WO | WO2007100320 | | 9/2007 |
| WO | 2008134845 | A1 | 11/2008 |
| WO | WO2008134845 | | 11/2008 |
| WO | WO2009150174 | | 12/2009 |

* cited by examiner

GUTTER GUARD FOR FLOATING GUTTER AND KIT

RELATED PATENT APPLICATION

The present application claims priority from U.S. provisional patent application No. 62/582,998, filed Nov. 8, 2017 and entitled "GUTTER GUARD AND FLOATING GUTTER AND KIT", the disclosure of which is hereby incorporated by reference in its entirety.

TECHNICAL FIELD

The technical field generally relates to a gutter guard and gutter guard kits. More particularly, the technical field relates to a gutter guard and gutter guard kits that includes a dual-purpose gutter guard that both acts as a gutter hanger and as a gutter guard for a floating gutter.

BACKGROUND

Rain gutters are useful to collect rainwater that runs off the roof of a house or of a building and to route collected rainwater away from the foundation to a proper drainage area in order to avoid damages to the foundation, the soffit, the windows and/or the doors, for instance. Rain gutters generally include a trough channeling the rainwater to a downpipe or downspout, the trough being affixed to a supporting structure of the house or building such as the fascia board.

One or more gutter hanger members are used to support the gutter. One or more fasteners further secure the gutter hanger members to the supporting structure, whereby the gutter hangs from the supporting structure. Typically, each gutter hanger member engages front and rear walls of the gutter and part of the gutter hanger member is positioned slightly below the upper edges of the walls. The gutter hanger members may be positioned intermittently along the length of the gutter. Alternatively, a single continuous gutter hanger member, such as the T-Rex® (trade-mark), continuous hanger from Alu-Rex® (trade-mark), extending along the length of the gutter can be used to support the gutter.

Leaves and debris may accumulate within the trough of the gutter, which can prevent the rainwater from flowing through the trough. Gutter guards are used to protect the gutter by preventing leaves and debris from entering the trough of the gutter while still permitting rainwater to enter the trough.

SUMMARY

According to one aspect, there is provided a gutter guard for retaining a gutter and for covering an opening of the gutter, the gutter having a front wall and a rear wall and the opening being defined by a top edge of the front wall and top edge of the rear wall. The gutter guard includes a front portion operatively engageable with the front wall of the gutter, a rear portion having an upwardly and rearwardly extending hook member for retaining the rear wall of the gutter and an upstanding member being fastenable to an upstanding supporting structure, and a central portion extending between the front portion and the rear portion and having a plurality of throughholes formed therein.

According to another aspect, there is provided a gutter guard kit having the gutter guard described herein and the gutter having the front wall and the rear wall defining a gutter trough inbetween, the front wall being configured to operatively engage the front portion of the gutter guard and the rear wall having an inverted hook member extending into the gutter trough for operatively engaging the upwardly extending hook member of the rear portion of the gutter guard.

According to yet another aspect, there is provided a gutter guard for retaining a gutter and for covering an opening of the gutter, the gutter having a front wall and a rear wall and the opening being defined by a top edge of the front wall and a top edge of the rear wall, the gutter guard comprising a first sheet member having a front portion, a rear portion and a central portion extending between the front portion and the rear portion, the front portion being operatively engageable with the front wall of the gutter, the rear portion having an upwardly and rearwardly extending hook member for retaining the rear wall of the gutter and an upstanding member being fastenable to an upstanding supporting structure; and a second sheet member having a front portion, a rear portion and a central portion, the front portion of the second sheet member forming a first engagement with the front portion of the first sheet member, the rear portion of the second sheet member forming a second engagement with the front portion of the second sheet member and the central portion being stacked under and spaced apart from the central portion of the first sheet member.

According to one example embodiment, the gutter guard comprises a first sheet member having a first longitudinal side region and a second longitudinal side region, the first longitudinal side region of the sheet member being folded to form the front portion of the gutter guard and second longitudinal side region of the sheet member being folded to form the rear portion of the gutter guard.

According to one example embodiment, the rear portion comprises an inner substantially vertical wall extending downwardly from the central portion and the upwardly extending and rearwardly hook member extending upwardly and rearwardly from a bottom edge of the inner vertical wall.

According to one example embodiment, the upwardly and rearwardly extending hook member is formed from the first sheet member being folded onto itself.

According to one example embodiment, a first set of the plurality of throughholes is formed in the first sheet member; and the gutter guard further includes a second sheet member being stacked under and spaced apart from the first sheet member, a second set of the plurality of throughholes being formed in the second sheet member.

According to one example embodiment, the first set of throughholes are non-aligned with the second set of throughholes in a direction perpendicular to the first and second sheet members.

According to one example embodiment, a front portion of the first sheet member comprises a front hook member formed from folding the first sheet member, the front hook member thereby having two layers, a front region of the second sheet member cooperatively engages the front portion of the first sheet member, and a rear portion of the second sheet member is folded over the upwardly extending hook member of the rear portion of the gutter guard.

According to one example embodiment, the second sheet member comprises a plurality of ridges extending upwardly from an upper surface of the second sheet member, the plurality of ridges abutting a lower surface of the first sheet member.

According to one example embodiment, the first sheet member comprises a plurality of ridges extending upwardly from an upper surface of the first sheet members, the plurality of ridges of the second sheet member being cooperatively received within the plurality of ridges of the first sheet member.

According to one example embodiment, an upper region of the upstanding member of the rear portion is configured to receive one or more fastener members for connecting to the upstanding supporting structure.

According to one example embodiment, the upwardly and rearwardly extending hook member is vertically and horizontally spaced-apart from the upstanding member, the upwardly and rearwardly extending hook member being located forwardly and below the upstanding member.

According to one example embodiment of a gutter kit, the gutter is deformable in a lengthwise direction thereof when engaged with the gutter guard According to one example embodiment of a gutter kit, the gutter is engageable with the upstanding supporting structure via the upstanding member of the gutter guard with the rear wall of the gutter extending below the upstanding member of the gutter guard when the gutter guard is engaged with the gutter, whereby the gutter is disengaged from any fastener used to fasten the gutter guard to the upstanding supporting structure.

According to one example embodiment, the kit further includes a plurality of gutter guards, each one of the gutter guard having a length less than a length of the gutter.

According to one example embodiment of a gutter kit, the inverted hook member of the gutter is formed from folding inwardly a top edge of the rear wall of the gutter into the gutter trough.

According to one example embodiment of a gutter kit, the inverted hook member of the gutter is formed from crimping inwardly a top edge of the rear wall of the gutter.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

In the following description, there is described various embodiments related to a gutter guard and gutter guard kit. As will be readily understood by one skilled in the art, the gutter guard, gutter hanger member and gutter according to the embodiments presented herein and equivalents thereto may be provided separately or in combination. Such combination may or may not be commercialized as a kit to be assembled. In another embodiment, a gutter guard may be commercialized as a standalone component.

Although the embodiments of the gutter guard and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therein between, as well as other suitable geometrical configurations, may be used for the gutter guard, as will be briefly explained herein and as can be easily inferred here from by a person skilled in the art.

Moreover, it will be appreciated that positional descriptions such as “front”, “rear”, “upper”, and the like should be taken in the context of the figures only and should not be considered as limiting. More particularly, they correspond to the position and orientation of the gutter, when mounted to a supporting surface of a supporting structure, and the gutter guard when mounted onto a gutter. The rear position corresponds to portions adjacent to the supporting surface while the front position corresponds to portions opposed to the supporting surface. The inner position corresponds to portions/surfaces facing the gutter trough while the outer position corresponds to portions/surfaces facing outwardly.

Having discussed the general context of the gutter guard, optional embodiments will be discussed further hereinbelow. The embodiments according to the following description are given for exemplification purposes only.

Figure 1A:
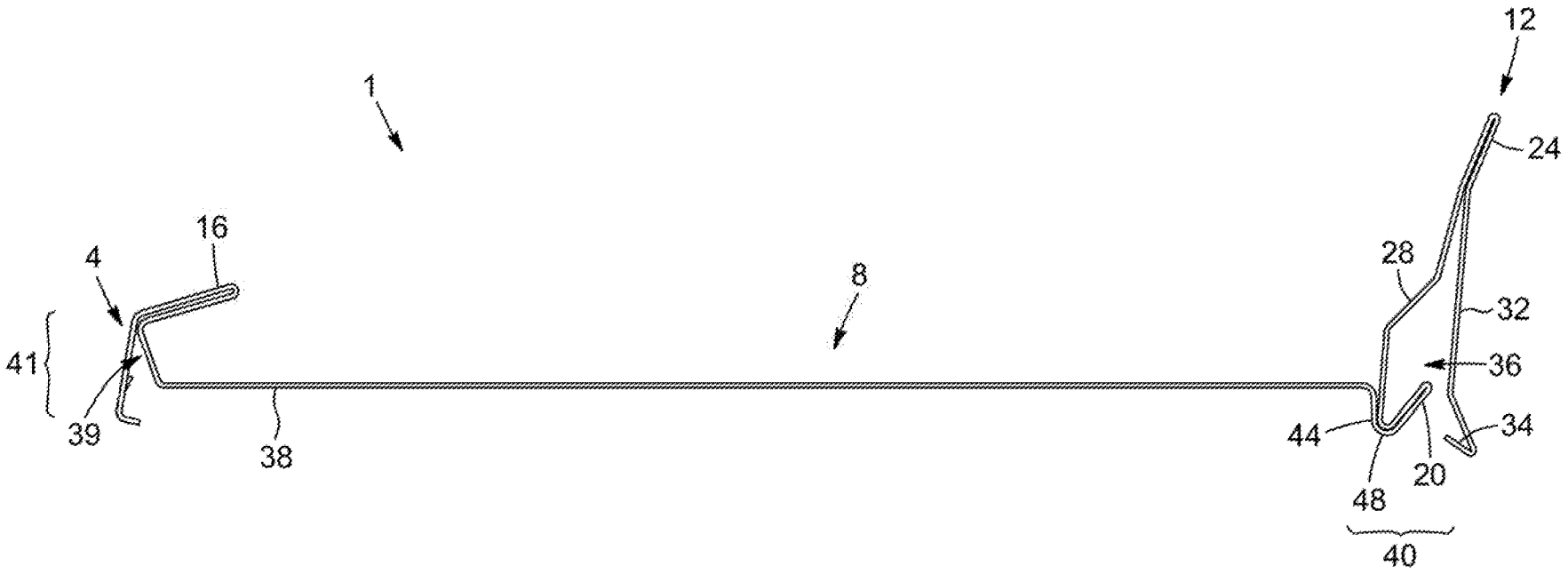
FIG. 1A illustrates a side elevation view of a dual-purpose gutter guard according to an example embodiment.
Figure 2A:
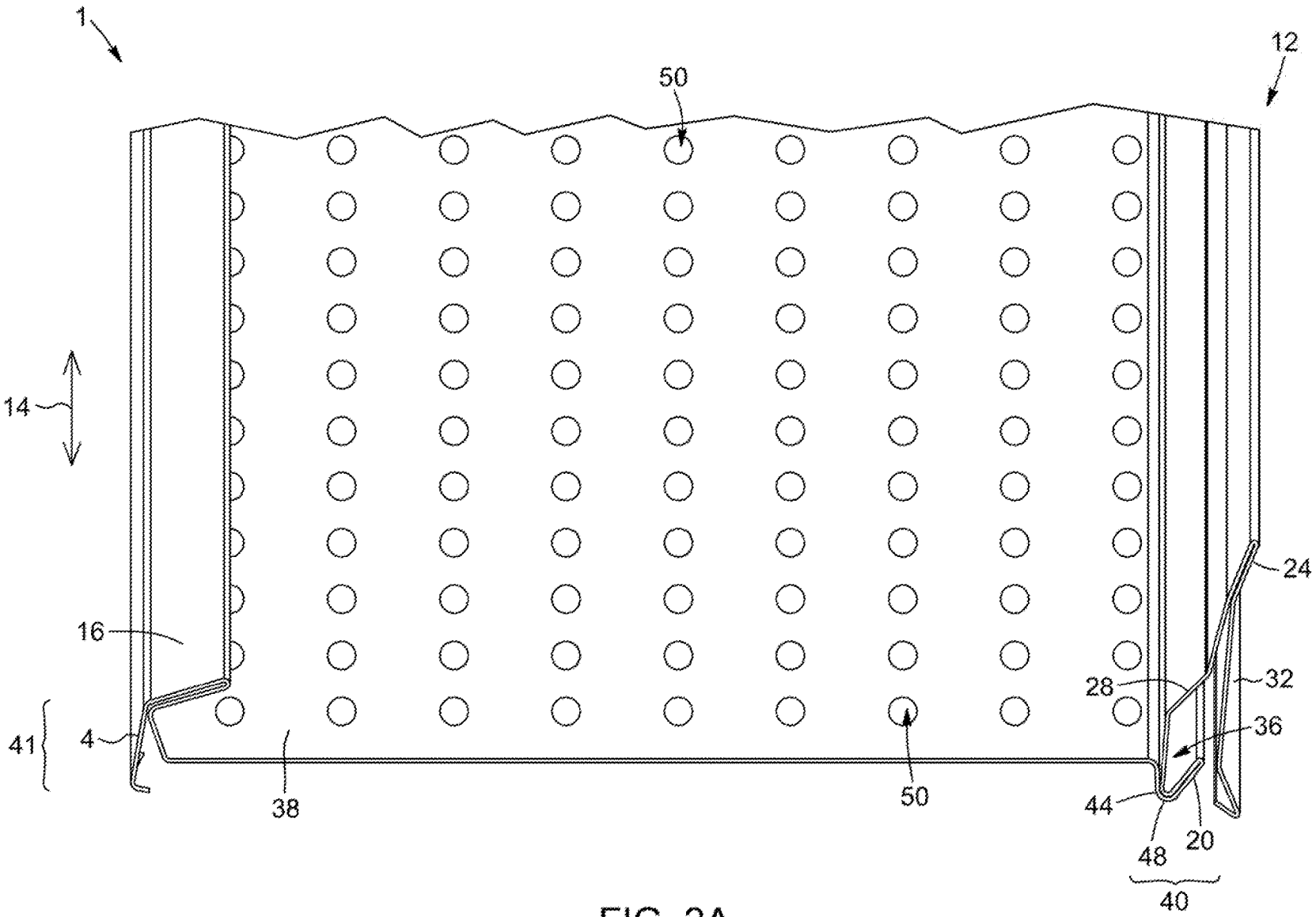
FIG. 2A illustrates a perspective view of the dual-purpose gutter guard according to the example embodiment.

Referring now to FIGS. 1A and 2A, therein illustrated is a side elevation view and a perspective view, respectively, of a dual-purpose gutter guard 1 according to a first example embodiment. The dual-purpose gutter guard 1, operable for retaining a floating gutter, includes a front portion 4, a central portion 8, and a rear portion 12. The front portion 4 and the rear portion 12 are respectively engageable with a front wall and a rear wall of a gutter. The central portion 8 extends between and connect the front portion 4 and the rear portion 12.

The dual-purpose gutter guard 1 may be a continuous gutter guard extending along a lengthwise direction 14 (FIG. 2A) thereof. The central portion 8 of the continuous dual-purpose gutter guard 1 has a plurality of through holes formed therein, such as being perforated.

In the illustrated embodiment, the front portion 4 includes at a front end thereof, a front upwardly extending segment 16 projecting upwardly and rearwardly from a front edge of the central portion 8. The upwardly extending segment 16 acts as a front hook member and is configured to be inserted into an inward recess of the top edge of the front wall of a floating gutter and engage a cooperating front inverted hook portion of the floating gutter, as described elsewhere herein. This engagement of the front hook member of the dual-purpose gutter guard 1 with the front inverted hook portion of the floating gutter causes the front portion 4 to retain the front wall of the floating gutter. It will be understood that this engagement may be formed without the use of any additional fasteners joining the front hook is member 16 of the dual-purpose gutter guard 1 with the front inverted hook portion of the floating gutter.

The rear portion 12 of the dual-purpose gutter guard 1 includes a rear upwardly extending segment 20. For example, and as illustrated, the rear upwardly extending segment 20 acts as a rear upwardly extending hook member and is configured to engage the top edge of the rear wall of the floating gutter and engage a cooperating rear inverted hook portion of the floating gutter, as described elsewhere herein.

The rear portion 12 of the dual-purpose gutter guard 1 also includes an upstanding member 24 that is fastenable to an upstanding supporting structure (not shown), such as a wall. A mechanical fastener may be used to secure the dual-purpose gutter guard 1 to the supporting structure. For example, a plurality of spikes, screws and/or ferrules may be positioned along the length 14 of the dual-purpose gutter guard 1 and project through the upstanding member 24 to secure the dual-purpose gutter guard 1 to the supporting structure.

As illustrated in FIG. 1A, the rear upwardly extending hook member 20 is vertically and horizontally spaced apart from the upstanding member 24. The upstanding member 24 is located above the rear upwardly extending hook member 20. More particularly, the upstanding member 24 may be extending rearwardly and upwardly from or relative to the upwardly and rearwardly extending hook member 20.

In the illustrated embodiment, the rear portion 12 includes an inner segment 28 and an outer segment 32 defining a channel 36 therebetween. The rear upwardly extending hook member 20 extends upwardly and rearwardly into the channel 36. The upstanding member 24 is formed from the mating of a top portion of the inner segment 28 with a top portion of outer segment 32.

The channel 36 is operable to receive a top region of the rear wall of the floating gutter, including a rear inverted hook portion that is engageable by the rear upwardly extending hook member 20 of the dual-purpose gutter guard 1, as will be described in more detail below. This engagement of the rear upwardly extending hook member 20 of the dual-purpose gutter guard 1 with the rear inverted hook portion of the floating gutter causes the rear portion 12 to retain with the rear wall of the floating gutter. It will be understood that this engagement may be formed without the use of any additional fasteners joining the rear hook member 20 of the dual-purpose gutter guard 1 with the rear inverted hook portion of the floating gutter.

According to one example embodiment, the gutter guard includes a first sheet member having a front longitudinal side region and a rear longitudinal side region. The first sheet member may be the first sheet member 38 illustrated in FIG. 1A. The sheet member 38 may be a metallic sheet member, such as an aluminum-based sheet. The sheet member 38 may be appropriately bent, folded and/or crimped to form the front portion 4, the central portion 8 and the rear portion 12 of the gutter guard 1. The front longitudinal side region can be folded to form an upstanding portion 41 that includes the front upwardly extending hook portion 16. Each layer of an upstanding portion 41 of the front longitudinal side region can define a V-shaped channel 39.

The rear longitudinal side region is also folded onto itself to form a double-layer segment 40. The segment 40 is then bent to form the rear upwardly extending hook member 20. In the illustrated example, the double layer segment 40 is bent to form an inner substantially vertical wall 44 extending downwardly from a rear region of the central portion 8. As shown in FIG. 1, the rear upwardly extending hook portion 20 extends upwardly and rearwardly from a lower edge 48 of the inner substantially vertical wall 44 into the channel 36.

The rear longitudinal side region is also folded, bent and/or crimped to form the inner segment 28 and the outer segment 32, which together define the upstanding member 24. A lower portion of the segment 32 may be folded upwardly and forwardly to form a lower hook member 34. As described elsewhere herein, the lower hook member 34 can be operable to engage a rear wall of a floating gutter.

It will be understood that in one example embodiment, the dual-purpose gutter guard 1 can consist essentially of the first sheet member 38 as illustrated in FIGS. 1A and 2A. That is, the sheet member 38 acts both to retain the floating gutter as a gutter hanger and to cover the opening of the floating gutter as a gutter guard. It will be further understood that according to this embodiment, a single layer of sheet metal having throughholes 50, corresponding to the central portion 8 of the sheet member 38, is used to cover the opening of the floating gutter.

Figure 1B:
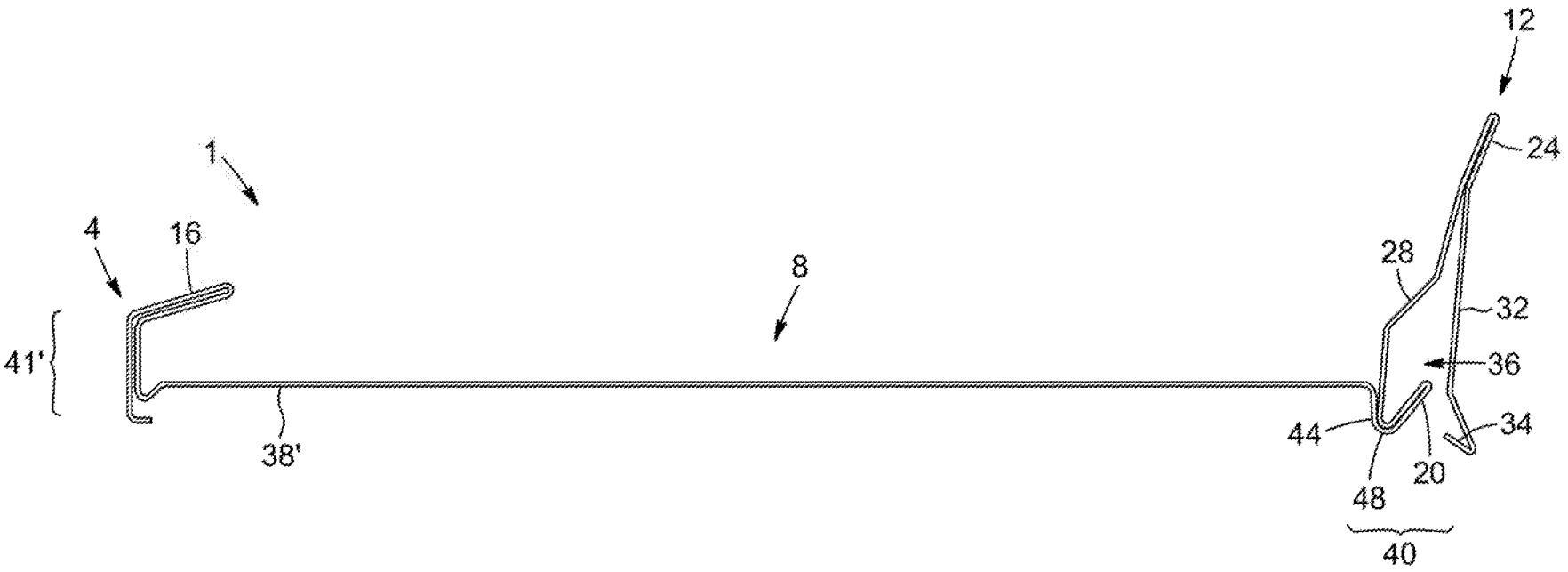
FIG. 1B illustrates a side elevation view of a dual-purpose gutter guard according to an alternative example embodiment.
Figure 2B:
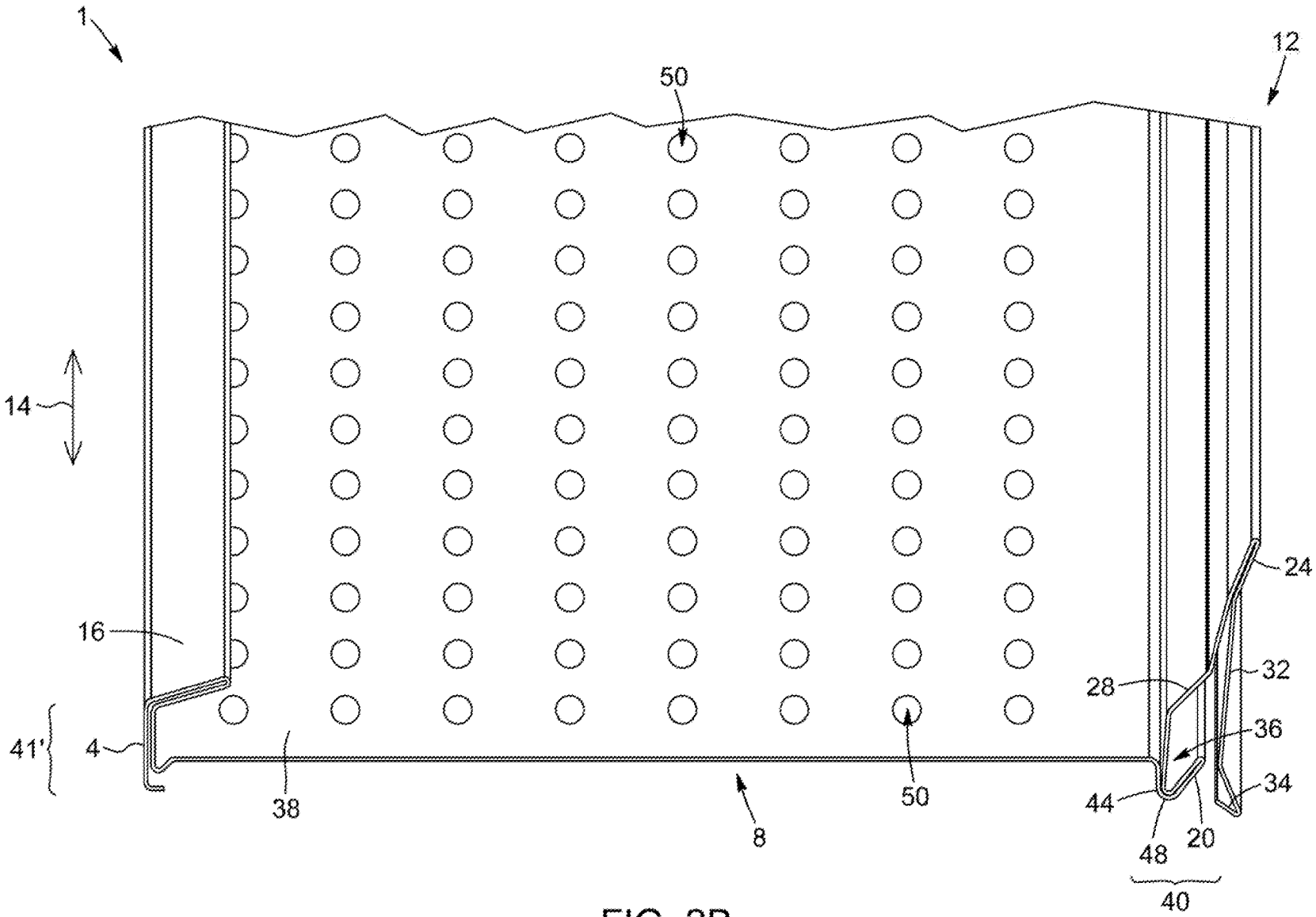
FIG. 2B illustrates a perspective view of a dual-purpose gutter guard according to an alternative example embodiment.

FIG. 1B illustrates a side elevation view of a first sheet member 38' of the dual-purpose gutter guard 1 according to an alternative example embodiment. FIG. 2B illustrates a perspective view of the first sheet member 38' according to the alternative example embodiment. The alternative first sheet member 38' has substantially the same characteristics as the sheet member 38 described herein with reference to FIGS. 1A and 2A except that the front longitudinal side region is folded onto itself to form a double-layer upstanding segment 41', a portion of which forms the front upwardly extending hook portion 16.

According to one alternative example embodiment, the dual-purpose gutter guard is a multi-layer gutter guard formed of the first sheet member 38 as illustrated in FIGS.

1A and 2A and a second sheet member. The second sheet member is stacked under and spaced apart from the first sheet member. A first set 50 of the plurality of throughholes is formed in the first sheet member and a second set of the plurality of throughholes is formed in the second sheet member.

The first set 50 of throughholes in the first sheet member 38 may be at least partially non-aligned with the second set of throughholes in a direction perpendicular to the first and second sheet members 38, 52. For greater clarity, the first set 50 of throughholes in the first sheet member 38 may be offset in a horizontal plane along the surface of the first sheet member 38 from the second set of throughholes of the second sheet member 52.

The first and second sheet members forming the dual-purpose gutter guard may be arranged (including various, non-alignment of the sets of throughholes) according to various example embodiments described in U.S. provisional application No. 62/554,328, U.S. patent application Ser. No. 16/121,964 and Canadian application no. 3,016,527, which are all incorporated herein by reference.

Figure 3A:
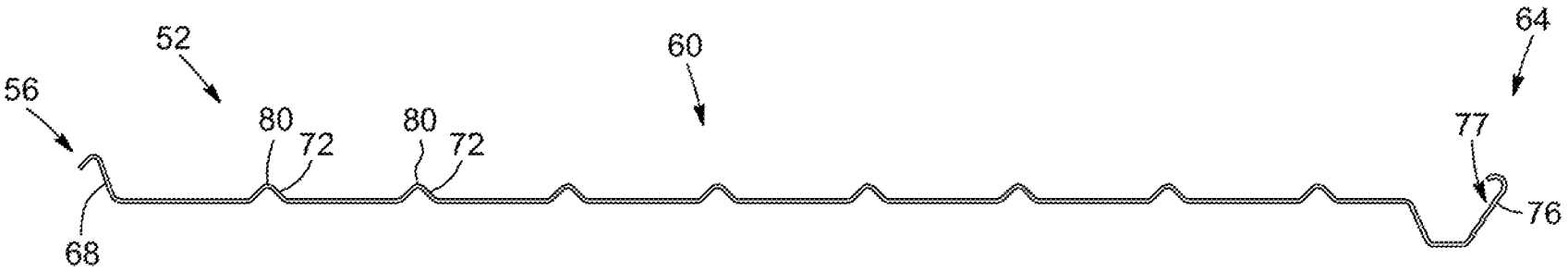
FIG. 3A illustrates a side elevation view of a second sheet member of the is dual-purpose gutter guard according to an example embodiment.
Figure 4A:
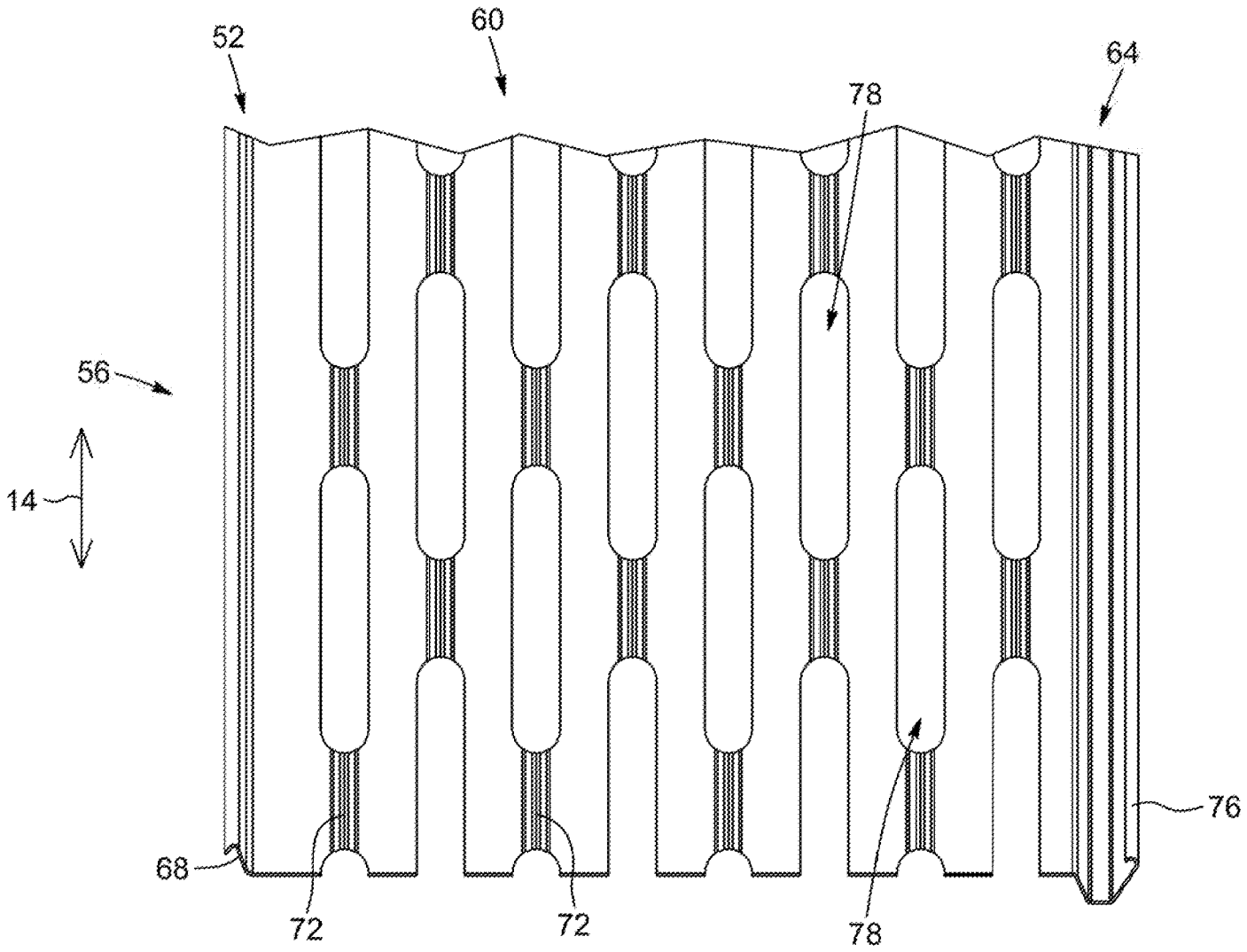
FIG. 4A illustrates a perspective view of the second sheet member dual-purpose gutter guard, as illustrated in FIG. 3A, according to the example embodiment.

Referring now to FIGS. 3A and 4A, therein illustrated are a side elevation view and a perspective view, respectively, of a second sheet member 52 according to an example embodiment. The second sheet member 52 includes a front portion 56, a central portion 60 and a rear portion 64. The second sheet member 52 may be formed of a metal sheet, such as an aluminum-based sheet.

The front portion 56 includes an upwardly extending segment 68 extending from a front region of the central portion 60. In the non-limitative embodiment shown, the upwardly and rearwardly extending segment 68 is a single layer that can be formed by bending and/or folding the second sheet member 52 as appropriate. The upwardly extending segment 68 of the second sheet member may be shaped to operationally engage the upwardly and rearwardly extending segment 16 of the first sheet member 38. The upwardly extending segment 68 can be shaped and sized to be receivable within the V-shaped channel 39 of the first sheet member 38.

The central portion 60 may include a plurality of ridges 72 extending upwardly from an upper surface of the central portion 60 and longitudinally along the second sheet member 52. The plurality of ridges 72 may also extend along a lengthwise direction 14 of the gutter guard.

In the non-limitative embodiment shown, the rear portion 64 includes an upwardly extending portion 76, ending with an inner bight, extending rearwardly and upwardly from a rear region of the central portion 60. The C-shaped portion 76 defines a channel 77. The contour of the inner bight may follow the shape of the rearwardly extending hook member 20 of the first sheet member 38.

As illustrated in FIG. 4A, the second set of throughholes 78 are elongated in shape. However, it will be understood that the second set of throughholes 78 may have other suitable shapes.

FIG. 36 illustrates a side elevation view of a second sheet member 52' of the dual purpose gutter guard 1 according to an alternative example embodiment. FIG. 4B illustrates a perspective view of the second sheet member 52' according to the alternative example embodiment. The alternative second sheet member 52 has substantially the same characteristics as the second sheet member 52 described herein with reference to FIGS. 3B and 4B. As illustrated, the alternative example embodiment includes an upwardly extending segment 68' that also extends rearwardly to follow the shape of the upwardly and rearwardly extending segment 16 of the first sheet member 38, as illustrated in FIG. 1A. The rear portion 64 of the alternative second sheet member can have an upwardly extending portion 76' that is C-shaped, which can also follow the shape of the rearwardly extending hook member 20 of the first sheet member 38 (or 38').

Figure 5A:
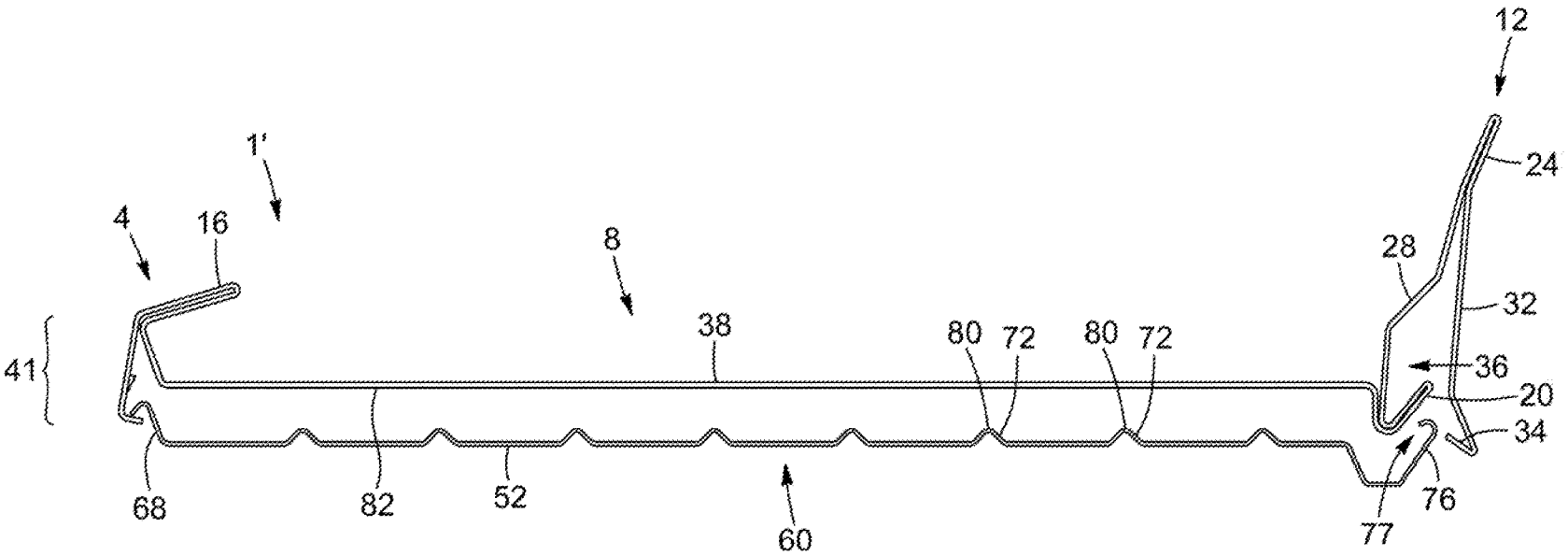
FIG. 5A illustrates a side elevation view of a multi-layer gutter guard according to an example embodiment, wherein the second sheet shown in FIGS. 3A and 4A is in the process of being superposed to the dual-purpose gutter guard shown in FIGS. 1A and 2A.
Figure 5B:
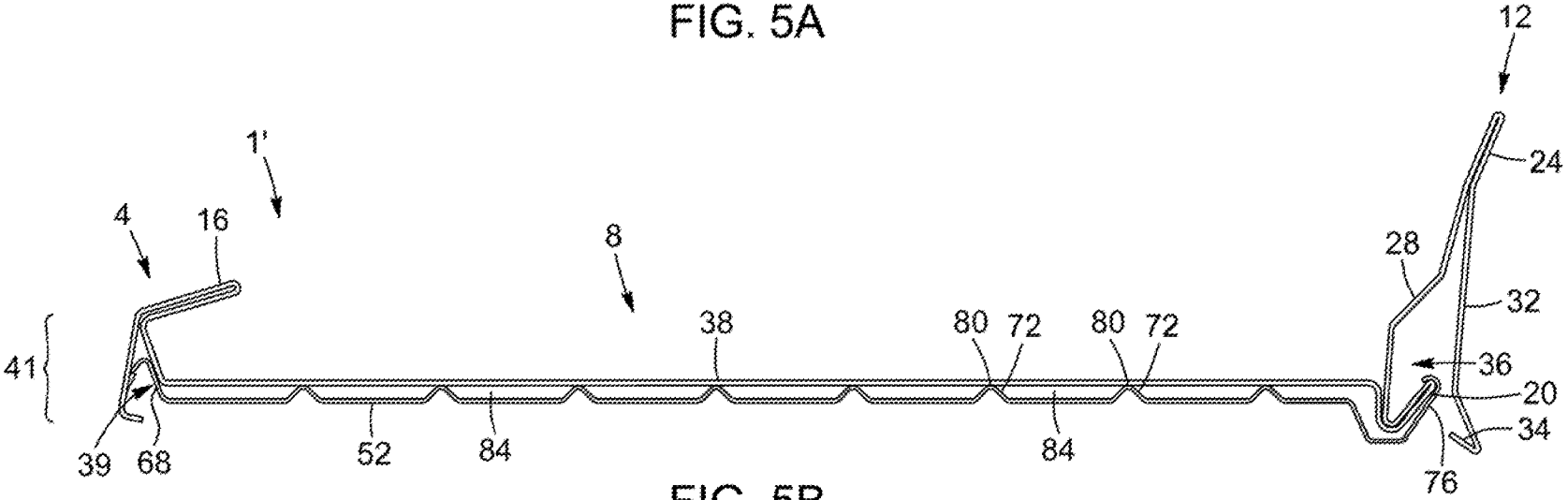
FIG. 5B illustrates a side elevation view of a multi-layer gutter guard according to an example embodiment, wherein the second sheet shown in FIGS. 3A and 4A is superposed to the dual-purpose gutter guard shown in FIGS. 1A and 2A.

Referring now to FIG. 5A, therein illustrated is a side elevation view of the first sheet member 38 and the second sheet member 52 in the process of being superposed and engaged with one another to form the multi-layer gutter guard 1' according to an example embodiment. FIG. 5B illustrates a side elevation view of the second sheet member 38 and the second sheet member 52 after being superposed and engaged with one another. The front upwardly extending segment 68 of the second sheet member 52 is received within the V-shaped channel 39 of the upstanding portion 41 of the front longitudinal side region of the first sheet member 38. As illustrated, the front upwardly extending segment 68 has an inverted V-shaped end that cooperatively engages inner surfaces of the upstanding portion 41 defining the V-shaped channel 39. This forms an engagement between the first and second sheet members 38, 52 in their respective front portions.

The apexes 80 of the plurality of ridges 72 of the central portion 60 abut a lower surface 82 of the first sheet member 38, thereby defining the space 84 between the first and second sheet members 38, 52.

The rear upwardly extending hook member 20 of the first sheet member 38 is received within the channel 77 defined by the upwardly extending portion 76 of the rear portion of the second sheet member 52. This forms an engagement between the first and second sheet members 38, 52 in their respective rear portions.

Figure 3B:
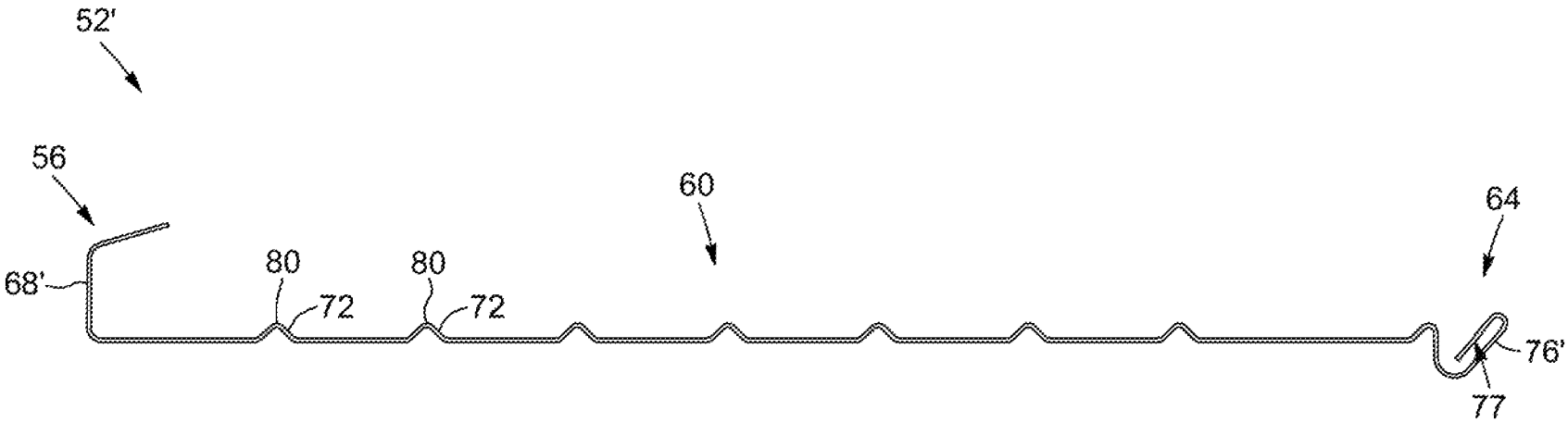
FIG. 3B illustrates a side elevation view of a second sheet member of the dual-purpose gutter guard according to an alternative example embodiment.
Figure 4B:
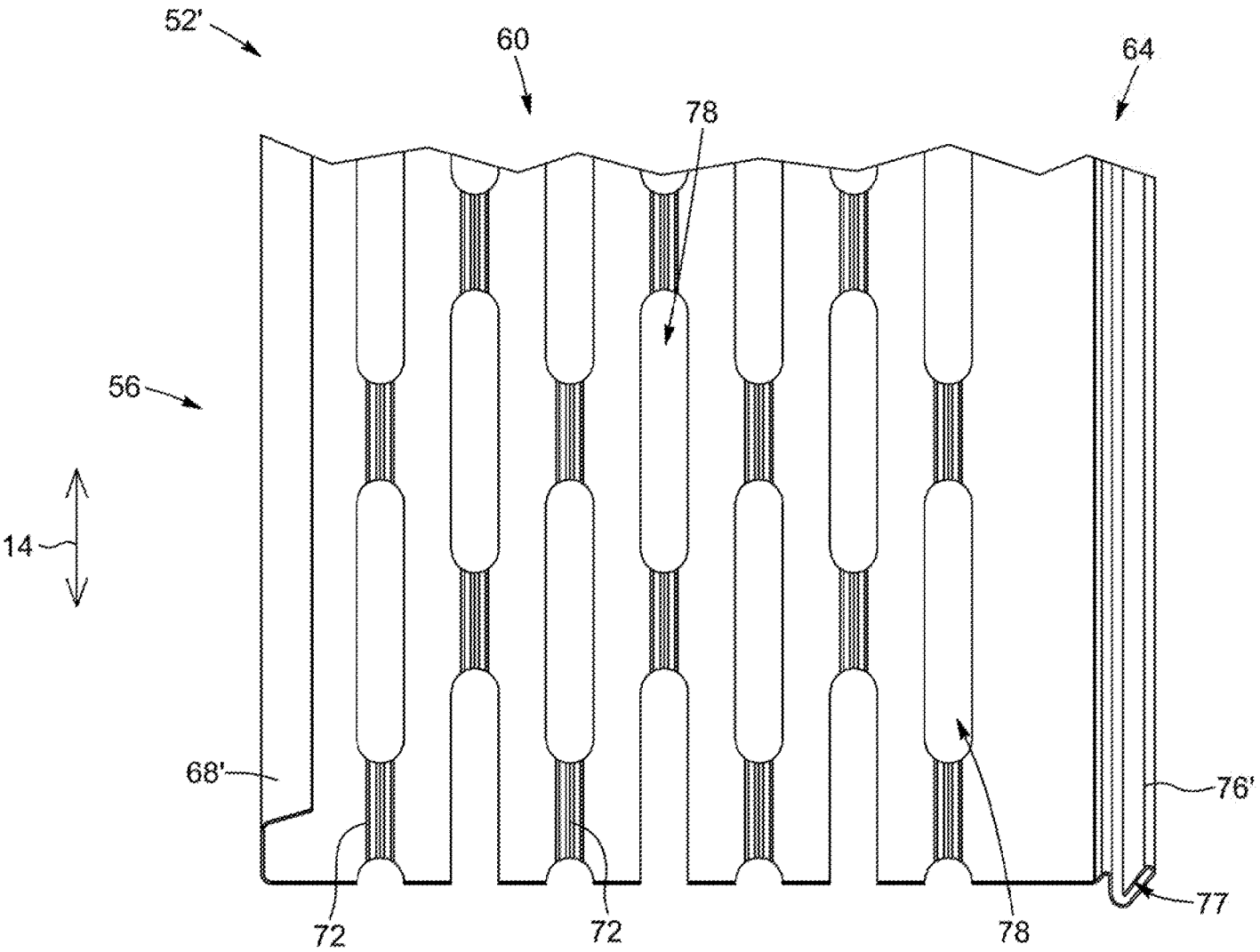
FIG. 4B illustrates a perspective view of the second sheet member dual-purpose gutter guard, as illustrated in FIG. 38, according to alternative example embodiment.
Figure 5C:
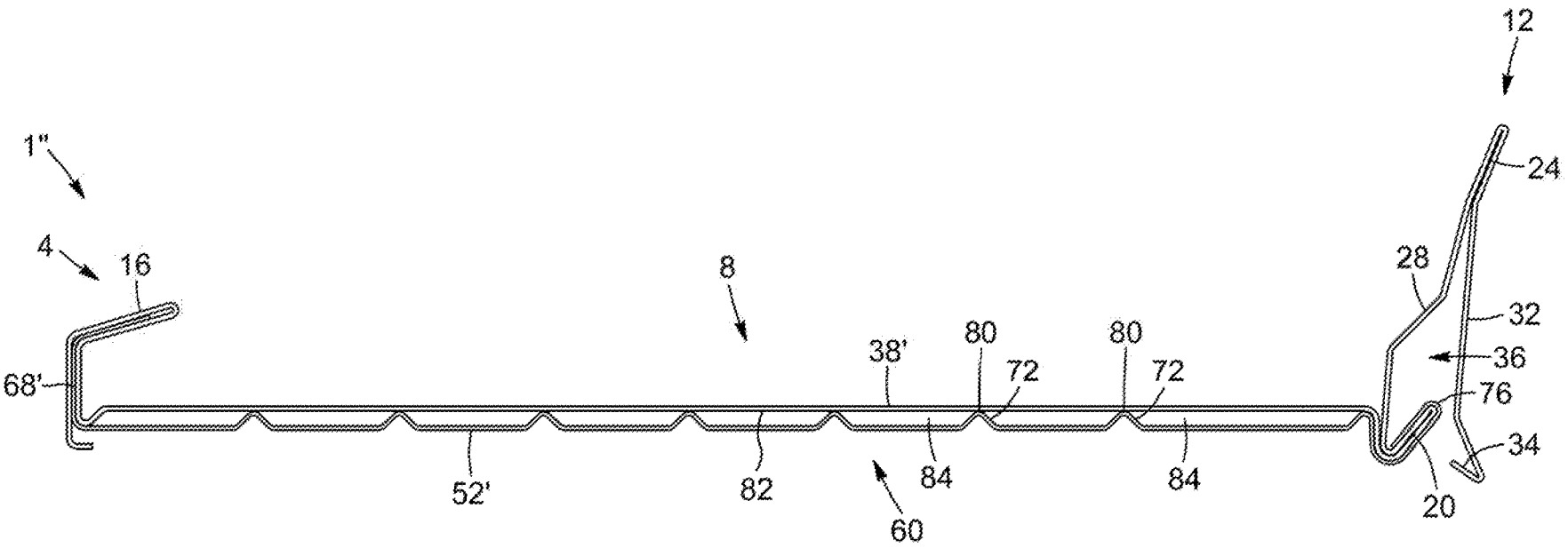
FIG. 5C illustrates a side elevation view of a multi-layer gutter guard according to an alternative example embodiment, wherein the alternative second sheet shown in FIGS. 3B and 4B is superposed to the alternative dual-purpose gutter guard shown in FIGS. 1B and 2B.

FIG. 5C illustrates a side elevation view of a multi-layer gutter guard 1" according to an alternative example embodiment, wherein the alternative second sheet member 52' shown in FIGS. 3B and 4B is superposed to the alternative first sheet member 38' shown in FIGS. 1B and 2B. It will be appreciated that the front upwardly extending segment 68' of the alternative second sheet member 52' is pinched between two layers of the upstanding portion 41' of the alternative first sheet member 38' to form the engagement between the first and second sheet members 38' and 52'.

Figure 6:
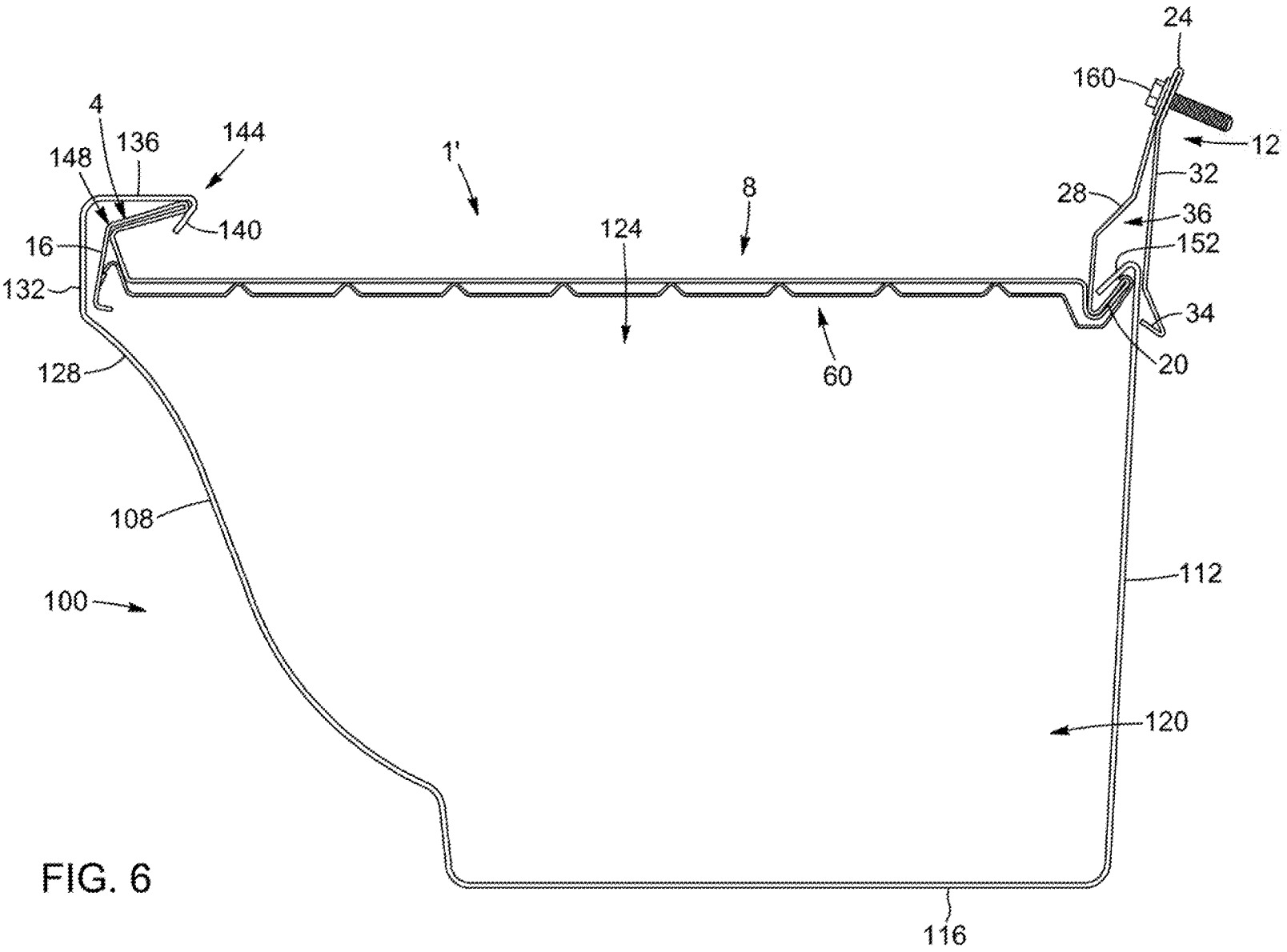
FIG. 6 illustrates a side elevation view of the dual-purpose gutter guard shown in FIGS. 5A and 5B having a floating gutter retained thereto according to an example embodiment.

Referring now to FIG. 6, therein illustrated is a side elevation view of the dual-purpose guard member 1' having a floating gutter 100 engaged therewith and retained thereto according to one example embodiment. The floating gutter 100 includes a front wall 108 and a rear wall 112 extending upwardly from a bottom wall 116 to define a trough 120 having an open top 124. The open top 124 of the floating gutter 100 may be defined between a top edge of the front wall 108 and a top edge of the rear wall 112 of the gutter 100. In the embodiment shown, the front wall 108 of the floating gutter 100 includes, successively, an outwardly inclined segment 128, an upright segment 132, an upper rim 136 and a downwardly frontwardly extending flange 140. The succession of the upright segment 132, the upper rim 136 and the downwardly frontwardly extending flange 140 define an inward recess 148. In turn, the upper rim 136 and the downwardly frontwardly extending flange 140 form a front inverted hook member 144 projecting into the inward recess 148. It will be understood that the shape of the front wall 108 can vary from the embodiment described above with reference to FIG. 6.

Figure 7:
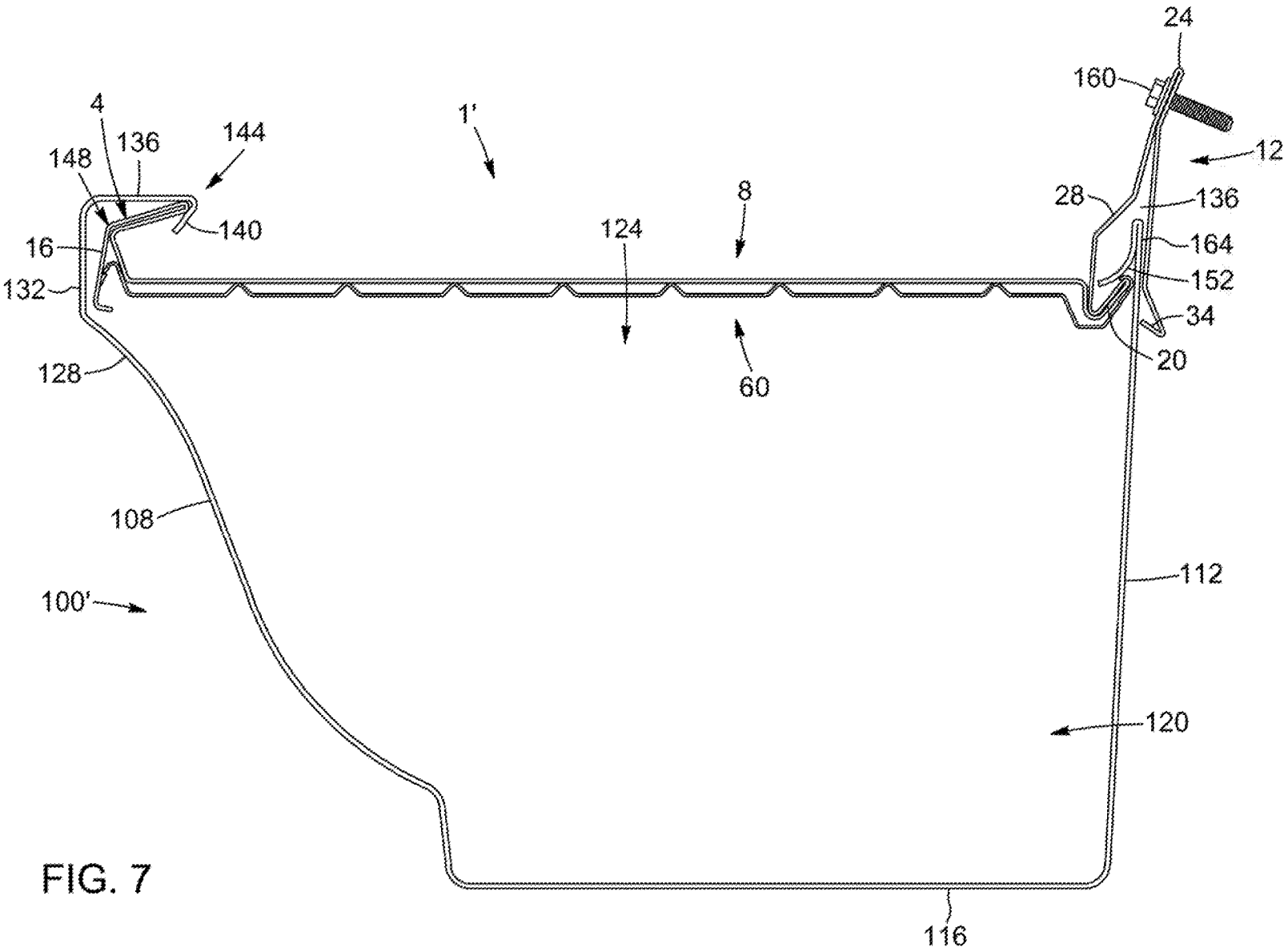
FIG. 7 illustrates a side elevation view of the dual-purpose gutter guard shown in FIGS. 5A and 5B having a floating gutter retained thereto according to another example embodiment.
Figure 9:
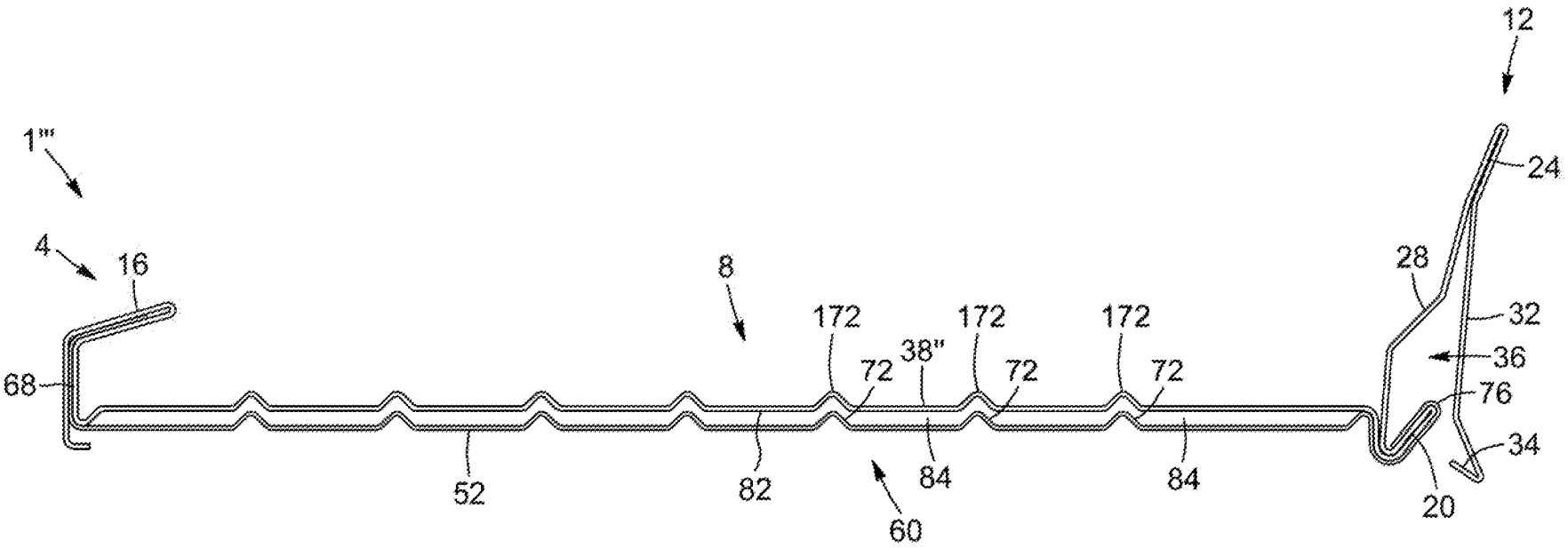
FIG. 9 illustrates a side elevation view of the dual-purpose gutter guard according to yet another example embodiment.

It will be understood that while FIGS. 6, 7 and 9 illustrate the multi-layer dual-purpose guard member 1' being engaged with and retaining the floating gutter 100, the description provided herein relating to the interaction between the guard member 1 and the floating gutter 100 is also applicable to the single-layer guard member 1, as appropriate.

The front wall 108 of the floating gutter 100 is configured to operatively engage the front portion 4 of the gutter guard 1'. In the example illustrated in FIG. 6, the front upwardly extending hook member 16 is received within the inward recess 148 and hooks onto the front inverted hook member 144 of the floating gutter 100. Accordingly, the front wall 108 of the floating gutter 100 is retained by front upwardly extending hook member 16 of the dual-purpose gutter guard 1'.

The top edge of the rear wall 112 of the floating gutter 100 includes a rear inverted hook member 152 folded inwardly, i.e. towards the trough 120 of the floating, gutter 100. As illustrated, the top edge includes a segment that extends forwardly and downwardly to form the rear inverted hook member 152. The rear inverted hook member 152 is illustrated as being formed by bending and/or folding the top edge of the rear wall 112 forwardly and downwardly.

In the example illustrated in FIG. 6, the rear inverted hook member 152 is hooked onto the rear upwardly extending hook member 20 of the rear portion of the dual-purpose gutter guard 1', i.e. the rear upwardly extending hook member 20 is inserted into the rear inverted hook member 152. Accordingly, the rear wall 112 of the floating gutter 100 is retained by the rear upwardly extending hook member 20 of the dual-purpose gutter guard 1". The rear wall 112 of the floating gutter 100 can further be pinched between the rear upwardly extending hook member 20 and the outer segment 32. The hook member 34 can further apply a pinching force on an outer surface of the rear wall 112.

The central portion 8 (60) of the dual-purpose gutter guard 1" extends over the top opening 124 of the floating gutter 100, thereby serving a first purpose as a gutter guard to capture debris while allowing flow of fluids into the trough 120 of the floating gutter 100 through the plurality of throughholes 50 and/or 78 of the central portion 8 (60).

Continuing with FIG. 6, a fastener 160 projects through an upper region of the upstanding member 24 to fasten the dual-purpose gutter guard 1' to a supporting structure (not illustrated), such as a wall of a building. It will be appreciated that engagement of the rear inverted hook member 152 of the rear wall of the floating gutter 100 with the rear upwardly extending hook member 20 of the gutter guard 1' is located to be downwardly spaced apart from the fastener 160. The fastener 160 does not project through the rear wall of the floating gutter 100. That is, the floating gutter 100 is disengaged from any fastener 160 used to fasten the gutter guard 1' to the supporting structure. Accordingly, the floating gutter 100 is engageable with the supporting structure via the dual-purpose gutter guard 1 acting as an intermediate member. The dual-purpose gutter guard 1 is fastened to the supporting structure using fasteners 160 and the floating gutter 100 engages the supporting structure through the dual-purpose gutter guard 1', and in particular, through the engagements with the front upwardly extending hook member 16 and rear upwardly extending hook member 20 of the gutter guard 1'. It will be appreciated that the dual-purpose gutter guard 1 serves a second purpose of a gutter hanger to retain the floating gutter 100 and maintain a distance between the front and rear walls 108, 112 of the floating gutter 100. Furthermore, the rear wall 112 extends below the upstanding member 24 of the gutter guard when the gutter guard 1' is engaged with the gutter.

Referring now to FIG. 7, therein illustrated is a side elevation view of the dual-purpose guard member 1' having a floating gutter 100' retained thereto according to an alternative example embodiment. The alternative floating gutter 100' is substantially similar to the floating gutter 100 described herein with reference to FIG. 6. However, the rear inverted hook member 152 is formed by forming a plurality of spaced-apart crimps 164 along the rear wall 1 of the gutter 100', adjacent to the top edge thereof. The crimped portion 164 is illustrated in FIG. 7. The top edge of rear wall 112 may be crimped at various points along the length of the gutter 100' to form the crimped rear inverted hook members 152.

It was observed that retaining the floating gutter 100 with the dual-purpose gutters guard 1, 1' from engagements of the front upwardly extending hook member 16 with the front inverted hook member 144 and of the rear upwardly extending hook member 20 with the rear inverted hook member 152 allows for greater thermal deformation (expansion and/or contraction) of the floating gutter 100. The floating gutter 100 can undergo a greater thermal deformation than the dual-purpose gutters guard 1, 1'.

More particularly, it was observed that the fastening of a member to the supporting structure using a fastener, such as fastener 160, has the effect of restricting the thermal deformation of that member. This may be due to a difference in the amount of deformation between that member (typically a metallic member) and the supporting structure. This difference in thermal deformation can cause the member to bend, rip and/or shear over time.

In the case of a gutter, the gutter will typically be very long, thereby experiencing greater thermal deformation. When a standard gutter is directly fastened to the supporting structure using one or more fasteners, the fasteners restrict the amount of thermal deformation that the gutter can undergo, thereby causing the gutter to become more susceptible to bending ripping and/or shearing.

Advantageously, because the dual-purpose gutter guards 1, 1' described herein are configured to retain the floating gutter 100 in a way so that the floating gutter 100 is disengaged from any fasteners connected to the supporting structure, the floating gutter 100 is less restricted in its thermal deformation and less susceptible to bending, shearing and/or ripping.

According to one example embodiment, the dual-purpose gutter guards 1, 1' have a length that is less than the length of the floating gutter 100. In this way, the dual-purpose gutter guards 1, 1' undergo less thermal deformation and is less susceptible to bending, shearing and/or ripping even though it is fastened to the supporting structure using fasteners. The floating gutter 100 having the greater length, and not being directly fastened to the supporting structure, can undergo its full range of thermal deformation.

According to various example embodiments, a gutter guard lit includes at least one dual-purpose gutter guard 1, 1' described herein and at least one floating gutter 100. The kit may also include a plurality of gutter guards 1, 1' combined with one floating gutter 100.

Figure 8:
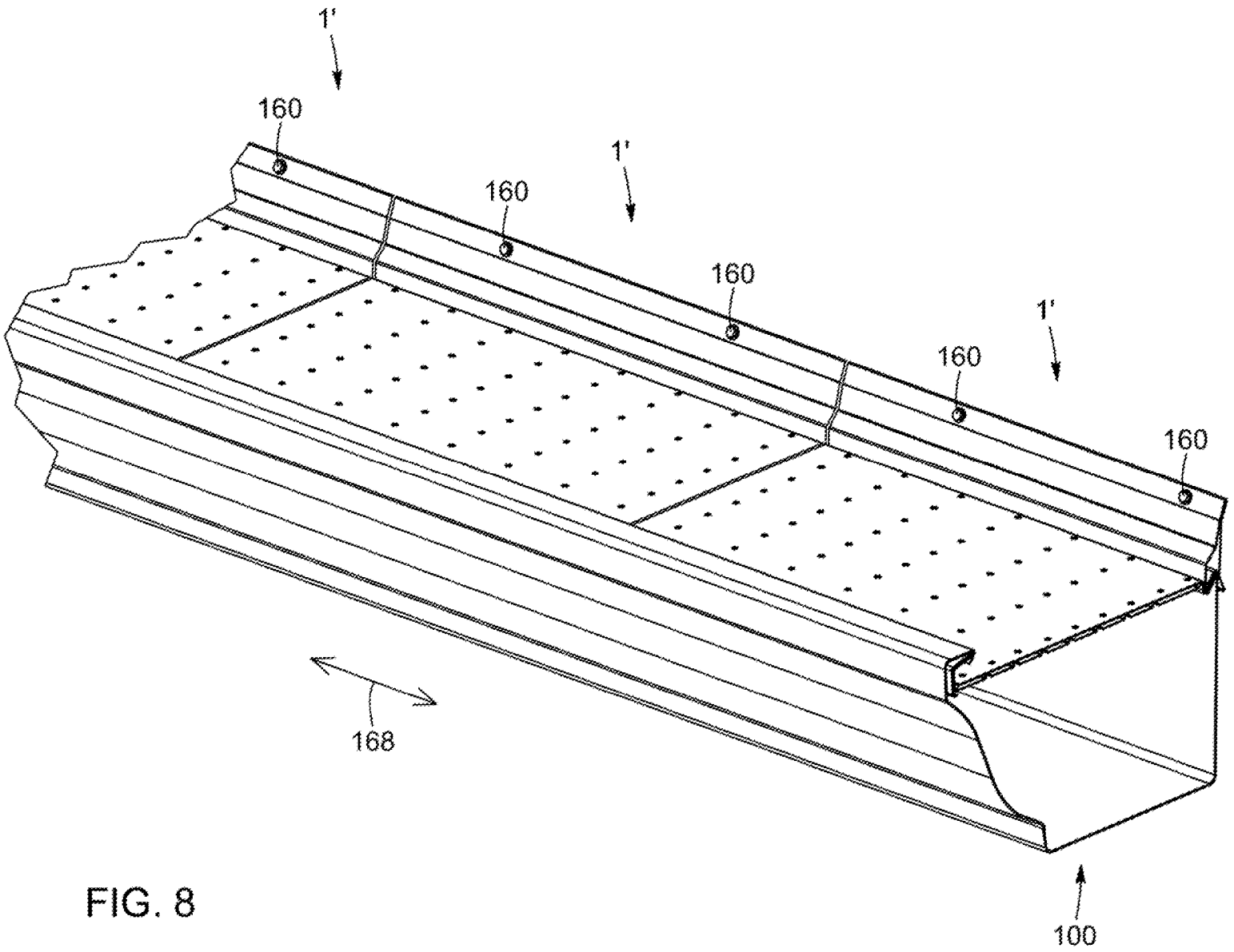
FIG. 8 illustrates a perspective view of a plurality of dual-purpose gutter guards fastened to a supporting structure and retaining a floating gutter according to an example embodiment.

Referring now to FIG. 8, therein illustrated is a perspective view of a plurality of dual-purpose gutter guards 1' and a floating gutter 100 having been installed according to an example embodiment. The dual-purpose gutter guards 1' are positioned substantially end to end. Each gutter guard 1 is connected to the supporting structure using fasteners 180. It will be understood that the ends of adjacent dual-purpose gutter guards 1' can be overlapping to ensure a continuous coverage of the open top 124 of the floating gutter 100. The plurality of dual-purpose gutter guards 1 retain a single floating gutter 100. It will be appreciated that the floating gutter 100 is substantially longer than any one of the dual-purpose gutter guards. The floating gutter 100 can undergo its full thermal deformation along its lengthwise direction 14 relative to the supporting structure and to the dual-purpose gutter guards 1'.

Referring now to FIG. 9, therein illustrated is a side elevation view of the dual-purpose gutter guard 1''' according to yet another example embodiment in which both central portion 8 of the first sheet member 38" and the central portion 60 of the second sheet member 52 have cooperating ridges 72 and 172. As illustrated, the central portion 8 of the first sheet member 38" has formed therein a plurality of upwardly extending ridges 172. When the second sheet member 52 is appropriately superposed and engaged with the first sheet member 38", the ridges 72 of the second sheet member 52 extend into the upwardly extending ridges 172 of the first sheet member 38". This cooperation of the ridges 72 and 172 of the two sheet members 38" and 52 can provide improved engagement between the sheet members.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A gutter guard for retaining a gutter and for covering an opening of the gutter, the gutter having a front wall and a rear wall and the opening being defined by a top edge of the front wall and top edge of the rear wall, the gutter guard comprising:

a front portion operatively engageable with the front wall of the gutter;

a rear portion having an upwardly and rearwardly extending hook member for retaining the rear wall of the gutter and an upstanding member being fastenable to an upstanding supporting structure; and a central portion extending between the front portion and the rear portion and having a plurality of throughholes formed therein;

wherein the gutter guard comprises a first sheet member having a first longitudinal side region and a second longitudinal side region, the first longitudinal side region of a first sheet member being folded to form the front portion of the gutter guard and the second longitudinal side region of the first sheet member being folded to form the rear portion of the gutter guard, wherein a first set of the plurality of throughholes is formed in the first sheet member;

wherein the gutter guard further comprises a second sheet member being stacked under and spaced apart from the first sheet member, a second set of the plurality of throughholes being formed in the second sheet member;

wherein a front portion of the first sheet member comprises a front hook member formed from folding the first sheet member, the front hook member thereby having two layers;

wherein a front region of the second sheet member cooperatively engages the front portion of the first sheet member; and wherein a rear portion of the second sheet member is folded over the upwardly extending hook member of the rear portion of the gutter guard.

2. A gutter guard kit comprising:

a gutter having a front wall and a rear wall defining a gutter trough inbetween, and an opening being defined by a top edge of the front wall and top edge of the rear wall, and the rear wall having an inverted hook member extending into the gutter trough;

a gutter guard for retaining the gutter and for covering the opening of the gutter, the gutter guard comprising:

a front portion operatively engageable with the front wall of the gutter;

a rear portion having an upwardly and rearwardly extending hook member for retaining the rear wall of the gutter and an upstanding member being fastenable to an upstanding structure, the inverted hook member of the clutter being operatively engageable with the upwardly and rearwardly extending hook member of the rear portion of the gutter guard; and a central portion extending between the front portion and the rear portion and having a plurality of throughholes formed therein.

3. The gutter guard kit of claim 2, wherein the gutter is deformable in a lengthwise direction thereof when engaged with the gutter guard.

4. The gutter guard kit of claim 2, wherein the gutter is engageable with the upstanding supporting structure via the upstanding member of the gutter guard with the rear wall of the gutter extending below the upstanding member of the gutter guard when the gutter guard is engaged with the gutter, whereby the gutter is disengaged from fasteners used to fasten the gutter guard to the upstanding supporting structure.

5. The gutter guard kit of claim 2, wherein the kit comprises a plurality of gutter guards, each one of the gutter guards having a length less than a length of the gutter.

6. The gutter guard kit of claim 2, wherein the inverted hook member of the gutter is formed from folding inwardly a top edge of the rear wall of the gutter into the gutter trough.

7. The gutter guard kit of claim 2, wherein the inverted hook member of the gutter is formed from crimping inwardly a top edge of the rear wall of the gutter.

8. The gutter guard kit of claim 2, wherein the gutter guard comprises a first sheet member having a first longitudinal side region and a second longitudinal side region, the first longitudinal side region of the sheet member being folded to form the front portion of the gutter guard and the second longitudinal side region of the sheet member being folded to form the rear portion of the gutter guard, wherein a first set of the plurality of throughholes is formed in the first sheet member; and wherein the gutter guard further comprises a second sheet member being stacked under and spaced apart from the first sheet member, a second set of the plurality of throughholes being formed in the second sheet member.

9. The gutter guard kit of claim 8, wherein the gutter is engageable with the upstanding supporting structure via the upstanding member of the gutter guard with the rear wall of the gutter extending below the upstanding member of the gutter guard when the gutter guard is engaged with the gutter, whereby the gutter is disengaged from any fastener used to fasten the gutter guard to the upstanding supporting structure.

10. A gutter guard for retaining a gutter and for covering an opening of the gutter, the gutter having a front wall and a rear wall and the opening being defined by a top edge of the front wall and a top edge of the rear wall, the gutter guard comprising:

a first sheet member having a front portion, a rear portion and a central portion extending between the front portion and the rear portion, the front portion being operatively engageable with the front wall of the gutter, the rear portion having an upwardly and rearwardly extending hook member for retaining the rear wall of the gutter and an upstanding member being fastenable to an upstanding supporting structure; and a second sheet member having a front portion, a rear portion and a central portion, the front portion of the second sheet member forming a first engagement with the front portion of the first sheet member, the rear portion of the second sheet member forming a second engagement with the rear portion of the first sheet member and the central portion being stacked under and spaced apart from the central portion of the first sheet member.

11. A gutter guard for retaining a gutter and for covering an opening of the gutter, the gutter having a front wall and a rear wall and the opening being defined by a top edge of the front wall and top edge of the rear wall, the gutter guard comprising:

a front portion operatively engageable with the front wall of the gutter;

a rear portion having an upwardly and rearwardly extending hook member for retaining the rear wall of the gutter and an upstanding member being fastenable to an upstanding supporting structure; and a central portion extending between the front portion and the rear portion and having a plurality of throughholes formed therein;

wherein the gutter guard comprises a first sheet member having a first longitudinal side region and a second longitudinal side region, the first longitudinal side region of the sheet member being folded to form the front portion of the gutter guard and the second longitudinal side region of the sheet member being folded to form the rear portion of the gutter guard, wherein a first set of the plurality of throughholes is formed in the first sheet member;

wherein the gutter guard further comprises a second sheet member being stacked under and spaced apart from the first sheet member, a second set of the plurality of throughholes being formed in the second sheet member; and wherein the second sheet member comprises a plurality of ridges extending upwardly from an upper surface of the second sheet member, the plurality of ridges abutting a lower surface of the first sheet member.

12. A gutter guard for retaining a gutter and for covering an opening of the gutter, the gutter having a front wall and a rear wall and the opening being defined by a top edge of the front wall and top edge of the rear wall, the gutter guard comprising:

a front portion operatively engageable with the front wall of the gutter;

a rear portion having an upwardly and rearwardly extending hook member for retaining the rear wall of the gutter and an upstanding member being fastenable to an upstanding supporting structure; and a central portion extending between the front portion and the rear portion and having a plurality of throughholes formed therein;

wherein the gutter guard comprises a first sheet member having a first longitudinal side region and a second longitudinal side region, the first longitudinal side region of the first sheet member being folded to form the front portion of the gutter guard and the second longitudinal side region of the first sheet member being folded to form the rear portion of the gutter guard;

wherein the rear portion comprises an inner substantially vertical wall extending downwardly from the central portion and the upwardly and rearwardly extending hook member extending upwardly and rearwardly from a lower edge of the inner vertical wall;

wherein the upstanding member of the rear portion is fastenable to an upstanding support structure using a fastener projecting through the upstanding member; and wherein the upwardly and rearwardly extending hook member is downwardly spaced apart from the fastener.

13. The gutter guard of claim 12, wherein the upwardly and rearwardly extending hook member is formed from the first sheet member being folded onto itself.

14. The gutter guard of claim 12, wherein a first set of the plurality of throughholes is formed in the first sheet member; and wherein the gutter guard further comprises a second sheet member being stacked under and spaced apart from the first sheet member, and a second set of the plurality of throughholes being formed in the second sheet member.

15. The gutter guard of claim 14, wherein the first set of throughholes are at least partially non-aligned with the second set of throughholes in a direction perpendicular to the first and second sheet members.

16. The gutter guard of claim 14, wherein a front portion of the first sheet member comprises a front hook member formed from folding the first sheet member, the front hook member thereby having two layers;

wherein a front region of the second sheet member cooperatively engages the front portion of the first sheet member; and wherein a rear portion of the second sheet member is folded over the upwardly extending hook member of the rear portion of the gutter guard.

17. The gutter guard of claim 14, wherein the second sheet member comprises a plurality of ridges extending upwardly from an upper surface of the second sheet member, the plurality of ridges abutting a lower surface of the first sheet member.

18. The gutter guard of claim 11, wherein the first sheet member comprises a plurality of ridges extending upwardly from an upper surface of the first sheet member, the plurality of ridges of the second sheet member being cooperatively received within the plurality of ridges of the first sheet member.

19. The gutter guard of claim 12, wherein an upper region of the upstanding member of the rear portion is configured to receive one or more fastener members for connecting to the upstanding supporting structure.

20. The gutter guard of claim 12, wherein the upwardly and rearwardly extending hook member is vertically and horizontally spaced-apart from the upstanding member, the upwardly and rearwardly extending hook member being located forwardly and below the upstanding member.

21. The gutter guard of claim 12, wherein an apex of the upwardly and rearwardly extending hook member is spaced apart from the upstanding member.

22. The gutter guard of claim 12, wherein the rear portion comprises an inner segment and an outer segment defining a channel therebetween, the inner segment and the outer segment corresponding to segments of the sheet member;

wherein the upwardly and rearwardly extending hook member extends upwardly and rearwardly into the channel; and wherein the upstanding member is formed from mating of a top portion of the inner segment with a top portion of the outer segment.

* * * * *